United States Patent [19]

D'Elia et al.

[11] Patent Number: 4,728,158

[45] Date of Patent: Mar. 1, 1988

[54] MODULAR RACK STORAGE SYSTEM AND ITS METHOD OF ASSEMBLY

[75] Inventors: Ronald J. D'Elia, Greenwich; Philip N. DeVries, Roxbury, both of Conn.

[73] Assignee: Delco Associates, Inc., Greenwich, Conn.

[21] Appl. No.: 732,383

[22] Filed: May 9, 1985

[51] Int. Cl.[4] ..... A47B 87/02

[52] U.S. Cl. ..... 312/108; 211/184; 220/22.3; 312/257 R; 312/263; 403/405.1

[58] Field of Search ..... 312/108, 193, 195, 263, 312/257 R, 345, 257 A, 257 SM, 257 SK; 211/184; 403/405.1, 408.1; 220/324, 22.1, 22.2, 22.3, 22.4, 22.5, 22.6, 22

[56] References Cited

U.S. PATENT DOCUMENTS

| | | | |
|---|---|---|---|
| 626,429 | 6/1899 | Kearns | 211/184 |
| 626,430 | 6/1899 | Kearns | 211/184 |
| 999,974 | 8/1911 | Fauth | 211/184 X |
| 1,656,868 | 1/1928 | Davis et al. | 211/184 X |
| 1,736,574 | 11/1929 | Binks | 211/184 X |
| 2,478,376 | 8/1949 | DeSwart | 24/67.9 |
| 2,500,309 | 3/1950 | Dunham | 211/184 |
| 2,555,562 | 6/1951 | Bales | 403/408.1 X |
| 3,052,363 | 9/1962 | Foote, Jr. et al. | 211/184 X |
| 3,241,683 | 3/1966 | Blodee | 211/184 X |
| 3,452,878 | 7/1969 | Smith | 312/345 X |
| 3,589;525 | 6/1971 | Allen | 211/184 X |
| 3,730,605 | 5/1973 | Eckard | 211/184 X |
| 3,807,572 | 4/1974 | Luvara et al. | 211/184 X |

FOREIGN PATENT DOCUMENTS

| | | | |
|---|---|---|---|
| 206470 | 11/1955 | Australia | 211/184 |
| 2216916 | 10/1972 | Fed. Rep. of Germany | 312/263 |
| 1311988 | 11/1962 | France | 312/108 |
| 2400341 | 4/1979 | France | 312/263 |
| 607105 | 7/1960 | Italy | 211/184 |
| 177349 | 11/1961 | Sweden | 211/184 |
| 291217 | 6/1953 | Switzerland | 220/22.1 |
| 477842 | 10/1969 | Switzerland | 211/184 |
| 1046184 | 10/1966 | United Kingdom | 211/184 |

*Primary Examiner*—Kenneth J. Dorner
*Assistant Examiner*—Thomas A. Rendos
*Attorney, Agent, or Firm*—Roberts, Spiecens & Cohen

[57] ABSTRACT

A modular storage system comprising an elongated base part having two spaced continuous channels extending generally parallel to one another longitudinally of the base part, and at least one upright member extendable transversely of the base part and including a pair of downwardly projecting lugs respectively engaged in the channels in the base part. The lugs are spaced apart in relation to the spacing of the channels to enable the lugs to be inserted into the channels with the upright member vertical and at an angle to the channels whereupon the upright member can be turned to a position tranverse of the base part to secure the lugs in the channels and the upright member on the base part.

22 Claims, 16 Drawing Figures

FIG. 1
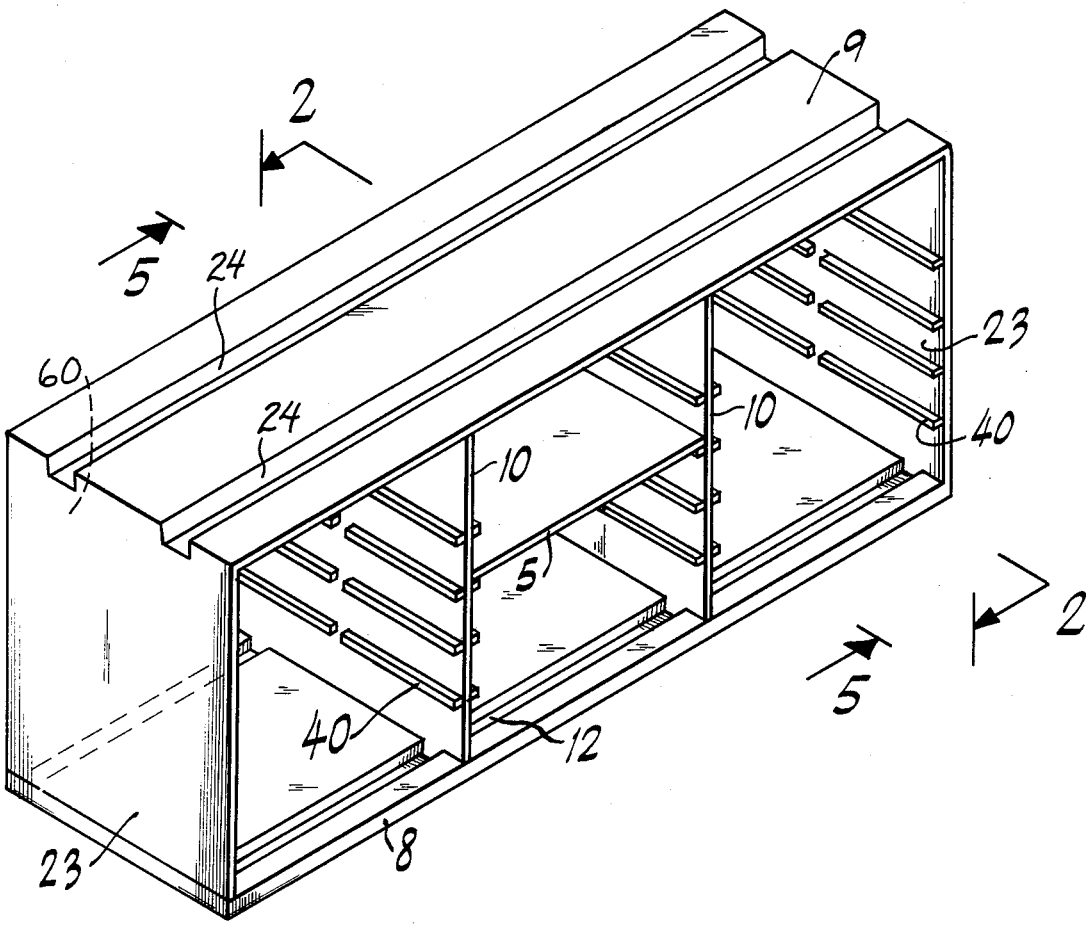
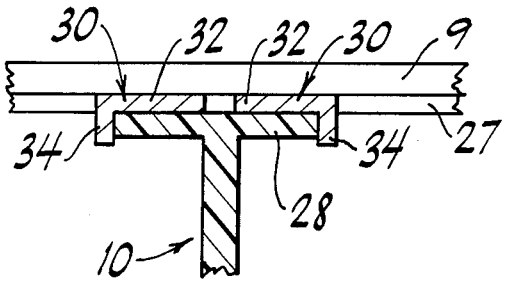
FIG. 3
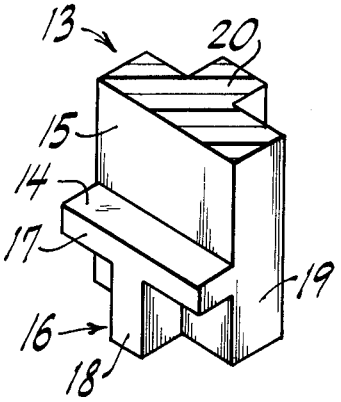
FIG. 8

FIG. 6
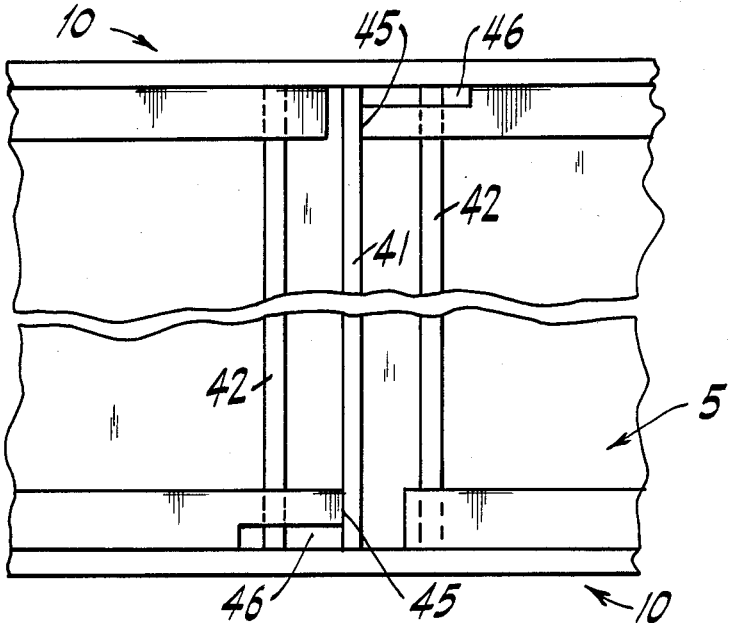
FIG. 7
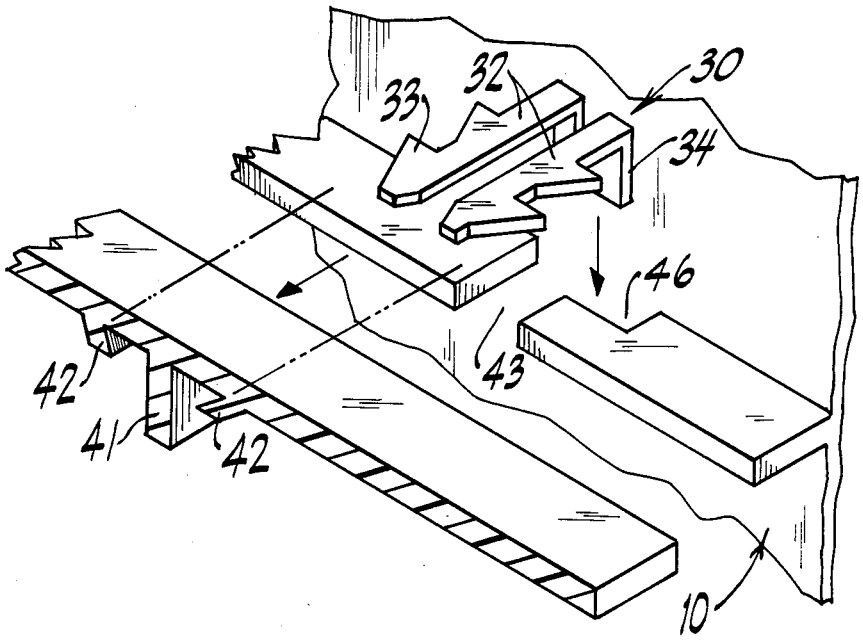
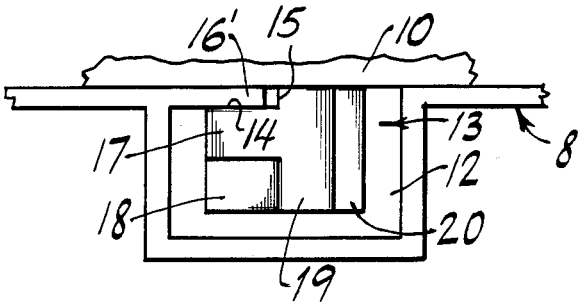
FIG. 9

MODULAR RACK STORAGE SYSTEM AND ITS METHOD OF ASSEMBLY

FIELD OF THE INVENTION

The invention relates to a modular storage rack system capable of being adapted for the storage of various articles such as papers and books and for sundries adapted for storage in drawers.

In a modular system, the user must be able to vary the configuration of the storage system by adding or subtracting shelves, drawers, shelf supports and dividers as desired.

In order to facilitate the modular nature of the storage system and permit adaptation to the utilization of various modules, such as shelves and dividers, numerous systems have been heretofore employed.

The invention is also related to the method of assembly of the various elements of the storage system in order to adapt it to the different configurations desired by the user.

BACKGROUND

In conventional storage systems, in order to adapt the system for various configurations of usage, it is common practice to provide a row of slots in bottom and top supports which are capable of supporting vertical plates in various locations. The vertical plates can be independent, free standing dividers for books or similar matter or they can serve as supports for shelves on which can be placed items to be stored, such as papers and other flat articles, for example, computer discs, records and the like.

The provision of the slots in bottom and top supports is limiting as far as placement of the vertical plates is concerned. This, in turn, limits the size of the shelves and requires a careful correlation between the shelves and the vertical plates and calls for relatively close tolerances so that the shelves will be properly supported by the vertical plates.

A typical example of a support system in which rows of slots are provided for adjustable positioning of vertical plates is found in U.S. Pat. No. 3,481,485. In this patent, the vertical plates are adjustable in different slots by engaging tabs at the lower edge of the plates into the slots. Additionally, each vertical plate cooperates with slots in a locking member for releasable locking of the vertical plate.

This system suffers from a number of disadvantages including the limitations of the placement of the plates relative to the slots which are provided in the base and to a general lack of rigidity due to the engagement of the plates with the base solely through the intermediary of the tabs at the bottom of the plates.

SUMMARY OF THE INVENTION

An object of the invention is to provide a modular storage system which is adjustable without limit or restriction as to placement of the vertical members and which is rigid when assembled.

A further object of the invention is to provide a storage system in which the vertical members are easily assembled on the base and capable of supporting shelves of different sizes.

Yet, another object of the invention is to provide a modular storage system whose elements are made of plastic material and involve the resilient interlocking of extruded and molded parts.

Still another object of the invention is to provide a modular storage system in which one assembly can be stacked on top of another.

A further object of the invention is to provide a method for assembly of a storage system which is readily adaptable to adjustment as to size and configuration and which involves easy assembly.

In accordance with the above and further objects of the invention, there is provided a modular storage system which comprises an elongated base part having two spaced continuous channels extending generally parallel to one another longitudinally of the base part and an upright member extendable transversely of the base part and including a pair of downwardly projecting lug means respectively engaged in said channels in said base part.

The aforesaid lug means are spaced apart in relation to the spacing of the channels to enable the lug means to be inserted into the channels with the upright member at an angle to the channels whereupon the upright member can be turned or angulated to a position extending transversely of the base part. The lug means are formed with engaging surfaces which operatively engage the channels in the transverse position of the upright member to hold the upright member securely in said transverse position.

A plurality of upright members can be assembled on the base part and shelves can be supported on the upright members to provide a desired configuration for the storage system.

Since the upright members can be continuously adjusted as regards the spacing therebetween, they can accommodate and support shelves of any size.

In accordance with a particular feature of the invention, the lug means on the upright member is in the form of a T-shaped projection which is secured into the channels in the base part when the upright member extends transversely of the base part.

In accordance with yet another feature of the invention, the system includes side parts which are engaged in the base part by lug means identical to those on the upright member, and the upright member and side parts are secured together as a rigid assembly by the interlocking of lips and recesses by snap-action wherein the lips can be provided on a closure member such as a back part or top part and the recesses can be formed in the upright member and side parts.

Further objects, features, and advantages of the invention will become apparent from a detailed consideration of a specific embodiment thereof, with reference to the attached drawings.

BRIEF DESCRIPTION OF THE FIGURES OF THE DRAWING

FIG. 1 is a front perspective view of a modular storage system of simplified configuration for explanatory purposes.

FIG. 3 is a sectional view taken on line 3—3 in FIG. 2.

FIG. 6 is a front view taken on line 6—6 in FIG. 5.

FIG. 7 is an exploded view on enlarged scale showing the assembly of a shelf of the storage system with an upright member.

FIG. 8 is a perspective view, on enlarged scale, of a lug portion of an upright member.

FIG. 9 is a side view on enlarged scale showing the engagement of the lug portion in a base part of the storage system.

DETAILED DESCRIPTION OF THE PREFERRED EMBODIMENT

Figure 13:
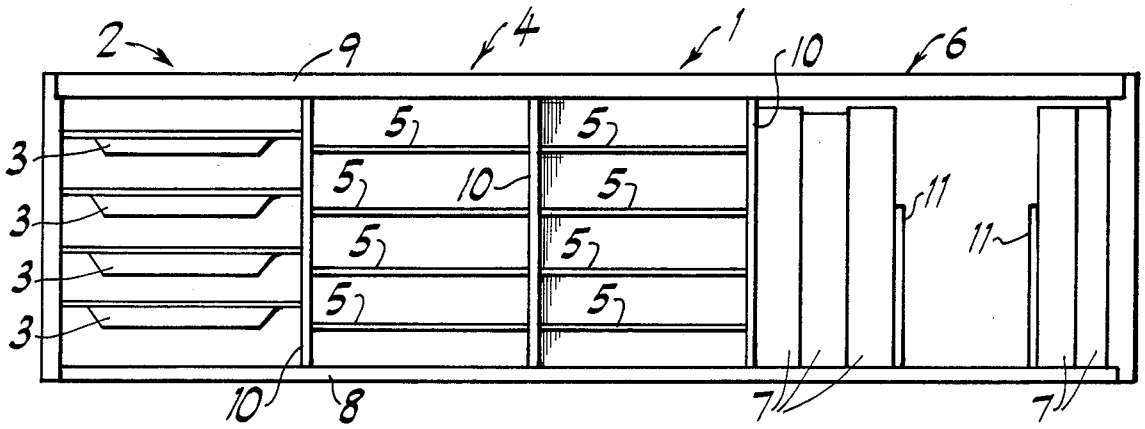
FIG. 13 is a front view of a typical modular storage system according to the invention.

Referring to FIG. 13, therein is seen a modular storage system 1 of typical configuration, which is given by way of example. It is to be understood that the very nature of a modular storage system is such as to enable its adaptability to take various different configurations according to the desires of the user.

In the system shown in FIG. 13, there is provided a section 2 with a plurality of drawers 3, superposed horizontally one above the other, a section 4 with a plurality of spaced horizontal shelves 5, and a section 6 for support of books 7, in spaced groupings.

The system includes a base part 8 and a top part 9 which extend through the various sections. Upright members 10 are connected to the base part and the top part to define and sub-divide the various sections and serve as supports for shelves 5 and drawers 3. In section 6 are seen dividers 11 which serve as supports for books 7.

The configuration of the storage system 1 can be varied as desired by adding or eliminating different sections, mainly by moving the upright members 10 with respect to the base part and top part and adding or removing shelves, drawers or book dividers.

With reference to FIG. 1, wherein the storage system is shown in a simplified form, the storage system is provided with two upright members 10 and a single shelf 5.

The base part 8, supports the upright members 10, in longitudinally channels 12, respectively provided in the front and rear of the base part 8.

The base part 8, is an elongated, extruded plastic member, preferably polystyrene, and the channels 12 extend continuously in substantially parallel relation to one another longitudinally of the base part. The upright member 10, has a pair of downwardly projecting lug means 13, which are respectively engaged in the channels 12 at the front and back of the base part when the upright member is in a transversely secured position on the base part.

Figure 2:
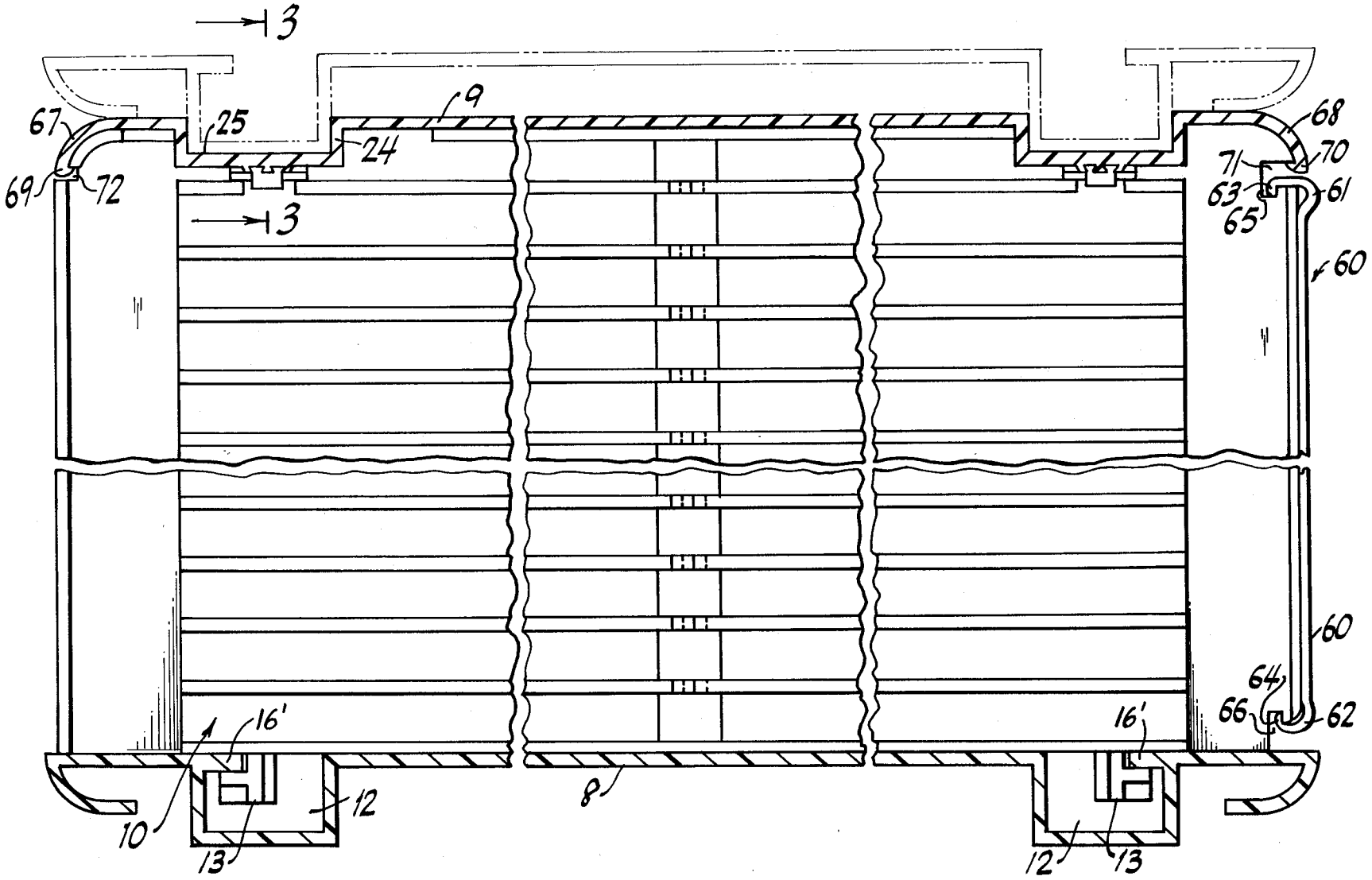
FIG. 2 is a sectional view of the storage system taken in a plane perpendicular to lines 2—2 in FIG. 1.
Figure 10:
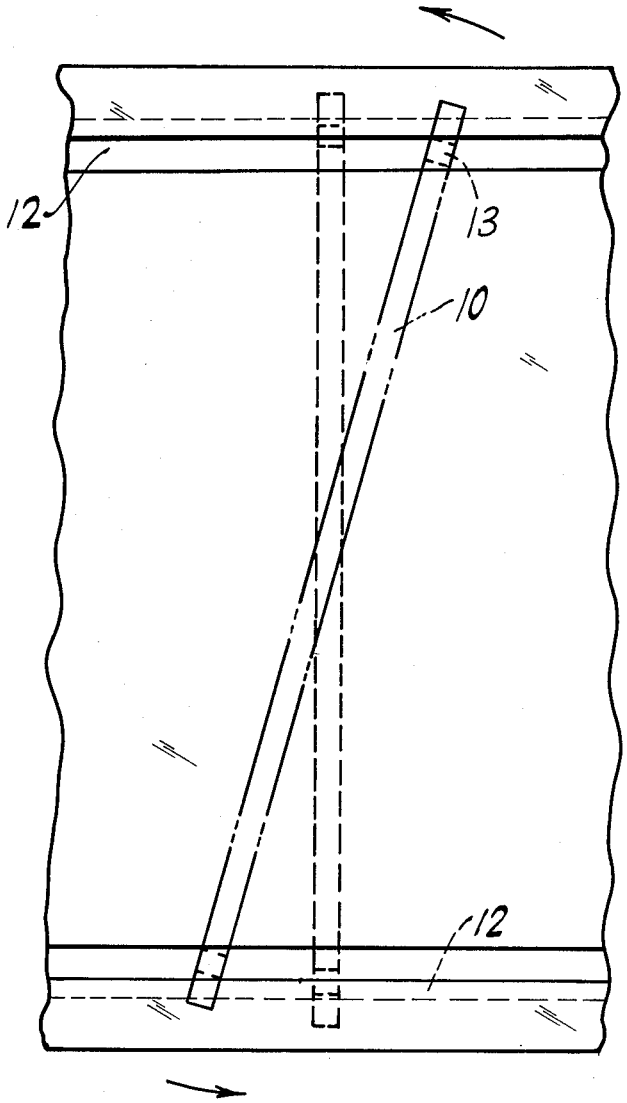
FIG. 10 is a top plan view diagrammatically illustrating the engagement of the upright member with the base part.

With reference to FIGS. 1, 2 and 10, therein it is seen that the lug means 13, are spaced apart in relation to the spacing of the channels 12 to enable the lug means to be inserted into the channels with the upright member 10 at an angle to the channels as shown in chain dotted outline in FIG. 10, whereupon the upright member 10 can be turned or angulated to a position transverse of the base part as shown in dotted outline in FIG. 10. As also seen from FIGS. 8 and 9, the lug means has engaging surfaces 14,15 which operatively engage the channels 12 in the transverse position of the upright member, to hold the upright member securely in its transverse position.

As seen in particular from FIG. 9, each channel 12 has a longitudinal rim 16' which cooperates with surfaces 14 and 15 of the lug means 13 to hold the upright member on the base part and prevent separation therefrom when the upright member is in transverse position with respect to the base part.

Effectively, the lug means comprises a T-shaped projection 16 which includes a first part 17 and a second part 18, which depends below and braces the first part 17. The engaging surface 14 is formed at the top of the first part 17. The T-shaped projection 16 projects from a third part 19, which is integral therewith and depends from the bottom of the upright member 10. A rear reinforcing part 20 projects from the back surface of part 19.

As evident from FIG. 10 the upright member 10 can be positioned at any location along the longitudinal channels 12 with the lug means 13, freely depending into the channels 12, so as to enable longitudinal adjustment of the upright member, and when the desired position of the upright member has been reached, it is turned to a transverse position in a plane perpendicular to the channels 12 so that the engaging surfaces 14 and 15 will cooperate with the rim 16' and lock the upright member in the desired position. The arrangement of the base part 8 and the upright member 10 is such that locking takes place by slight interference between surface 14 and the undersurface of rim 16' whereas the surface 15 is slightly spaced from the edge of rim 16'. This arrangement provides tight engagement to securely lock the upright member when it reaches its position transversely of the channels while permitting the upright member to be released, if desired, for adjustment to a new longitudinal position along the base part. The operation is very simple and permits the upright member to be locked into any desired adjusted postion along the longitudinal channels. As seen in FIGS. 2 and 10, the rims 16' project towards one another while the T-shaped projections 16 face in opposite directions away from one another. When the upright member 10 is angularly rotated about a vertical axis from its transverse position as shown in FIG. 10, the lug means 13 move out from under rims 16' to provide free dependency of the lug means in channels 12 which enables the upright member to be longitudinally displaced along base part 8 or removed therefrom and reinstalled at a different location.

In order to complete the assembly of the system 1 and provide rigidity thereof, side parts 23 are connected to the base part 8, top part 9 is connected to the side parts 23 and to the upright members 10 and a back part 60 is connected to the upright members and side parts. The engagement of the top part and back part with the upright members and side parts is by resilient snap-fit to hold the entire assembly under tension in a secure, rigid relation. In order to achieve the snap-fit of the parts, they must have resiliency so that elastic lips can snap into receiving recesses.

In particular, as seen in FIG. 2, the back part 60 has upper and lower rounded elastic portions 61,62 with respective lips 63,64 which can snap into recesses 65,66 formed at the top and bottom of each upright member 10 and side part 23. The rounded configuration of portions 61,62 facilitates the resilient engagement by snap-action of the lips in the recesses. The top part 9 has rounded end portions 67,68 with lips 69,70. Lip 70 engages the upper edge of a slot 71 from which recess 65 extends. Lip 69 snaps into a slot or recess 72 at the front of the upright members and side parts.

The snap engagement of the top part and back part with the upright members and side parts is easily effected and serves to resiliently secure the elements of the assembly together.

Figure 4:
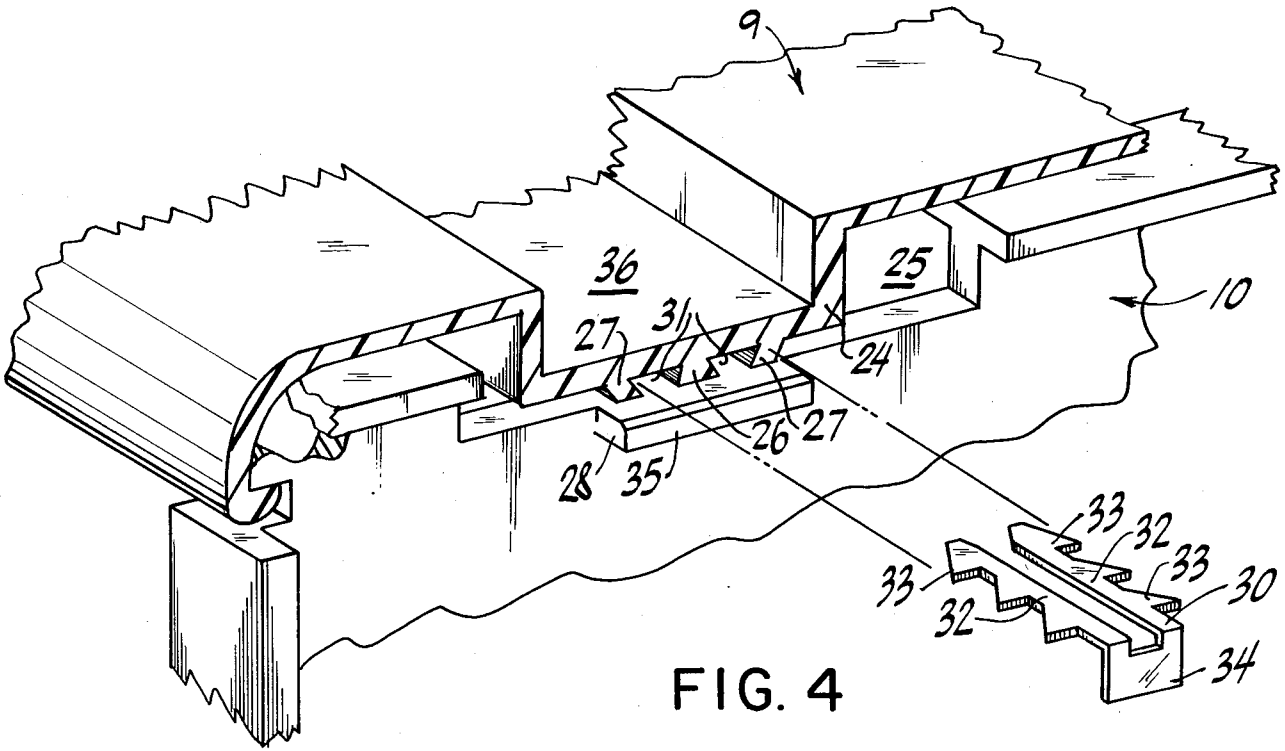
FIG. 4 is an exploded view, on enlarged scale, showing the assembly of a top part of the storage system with an upright member.

As also to be seen in FIGS. 2–4, the top part 9 is further engaged with the upright member 10 to hold the same laterally by means of clips 30 as will be explained hereafter. The top part 9 has a projection or a channel part 24 which engages in a recess 25 in the top of the upright member 10. At the bottom of the projection 24, is a central lug 26, of reverse frusto-conical shape and the lug 26 is flanked by two inwardly angled lugs 27. The lugs 26 and 27, rest on a plate-like rib 28 extending laterally from both sides of the upright member 10 and having an upper surface flush with the bottom of the recess 25. Locking clips 30 engage opposite sides of the rib 28 of the upright member to hold the upright member 10 laterally. In particular, channels 31,32 are formed between lug 26 and lugs 27 into which are inserted grip parts 32 of a clip 30. The grip parts 32 are formed with teeth 33 at their longitudinal edges for biting into the facing lug 27. The grip parts 32 are resilient and can be squeezed together to enable the clip to slide longitudinally along the lugs to a position to laterally engage the ribs 28 of an upright member. When a clip has reached a position for holding the rib of the upright member, the squeezing pressure on parts 32 is released so that teeth 33 hold the clip and a second engagement part or leg 34 which depends from the grip parts 32 bears against the edge 35 of the rib 28. Consequently, the top part holds the upright member and prevents transverse movement. It is to be understood, that the clips 30 are supplementary to the resilient locking engagement of the ends of the top part and the upright members.

The channel shape of part 24 of the top part 9 defines a recess 36 which is configured to receive depending channels 12 on the base part 8 of a second storage system as diagrammatically illustrated in chain dotted outline at the top of FIG. 2. In this way the storage systems can be stacked one on top of the other.

Each of the upright members 10 is provided with projecting ledges 40 on both sides of the upright member for the support of shelves 5. The side parts 23 are also formed with ledges 40 on the interioraiiy facing surfaces thereof. The projecting ledges are superimposed one above the other with a spacing to determine the minimal spacing of the shelves 5.

Basically, the shelves rest on the projecting ledges at opposite ends and in order to secure the shelves in determined position a particular configuration is provided for the shelves and ledges in combination with the clips 30.

Figure 5:
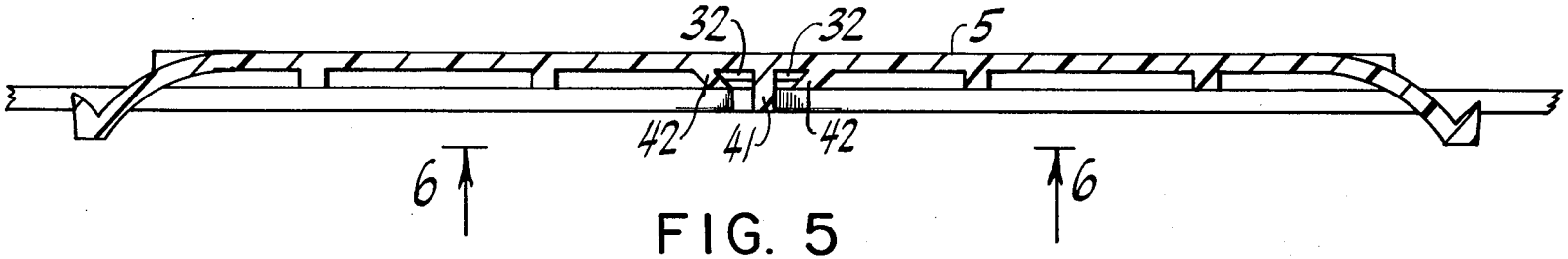
FIG. 5 is a sectional view taken along line 5—5 in FIG. 1.

In particular and with specific reference to FIGS. 5–7, each shelf 5 has a longitudinal depending rib 41 flanked by two inwardly inclined lugs 42.

The ledges 40 are specially configured and arranged on the opposite side surfaces of the upright members 10 in order to cooperate with the central rib 41 in order to lock the shelf fore and aft when the shelf is supported on the ledges of two spaced upright members. More particularly, as seen in FIGS. 6 and 7, each ledge is formed with a slot 43 and the slots on opposite surfaces of each upright member are slightly offset by the thickness of a rib 41, so that when the rib is placed in the slots 43 of facing upright members, the rib 41 will bear on opposite sides against bearing surfaces 45 of the ledges of the facing upright members 10. Slits 46 are formed in the ledges from the bearing surfaces 45 to accommodate depending legs 34 of clips 30 which have previously been inserted into the ends of the shelves by the locking engagement of legs 32 between lugs 42 and rib 41 of the shelves. As a consequence, the shelves will be secured against movement laterally of the upright members by engagement of legs 34 of the clips in the slits 46.

In operation, the clips are inserted in locked relation at opposite ends of each shelf with the teeth 33 of the grip parts biting into lugs 42. When one end of the shelf is supported on a ledge, the rib 41 positions itself against guide surface 45 while the depending leg 34 of the clip enters slot 46 whereby the shelf is held in position fore and aft and laterally. The shelf can be readily removed from the ledges and placed in a different horizontal position by lifting the shelf off the ledges.

Figure 11:
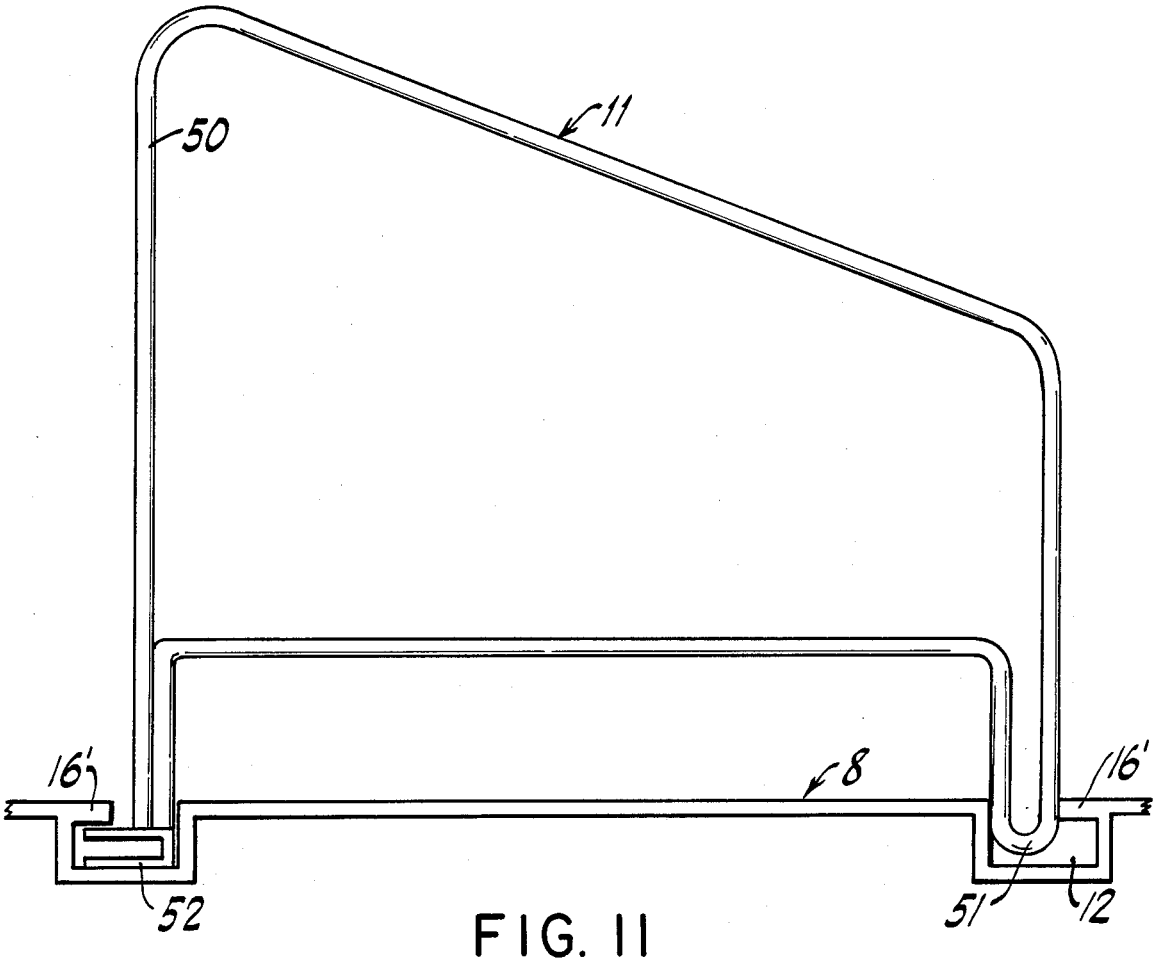
FIG. 11 is an elevational view showing the engagement of a wire book divider with the base part.
Figure 12:
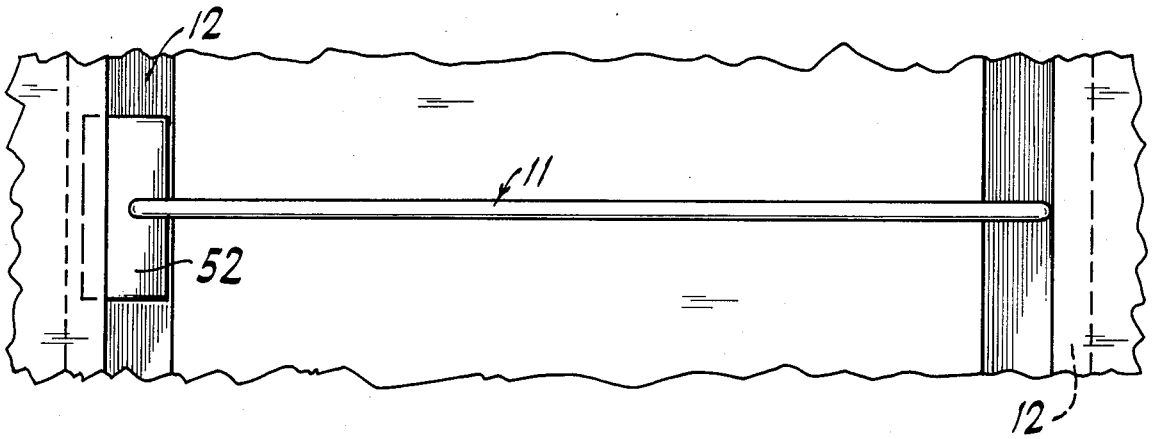
FIG. 12 is a top plan view diagrammatically illustrating the engagement of the book divider with the base part.

FIGS. 11 and 12 show the book divider 11 in greater detail and as seen, each book divider 11 is formed from a wire member 50, bent to a particular configuration to serve as a means to support an upstanding book. The wire member 50 is bent at its lower front portion to form a loop 51, which is positionable in channel 12 of the base part 8. The rim 16' of the channel cooperates with the loop 51 to snugly hold the same in the channel when the divider member 11 is in a transverse position with respect to the base part. At the rear of the divider member 11, there is mounted a lug means in the form of a shaped member 52 which is supported in the rear channel 12 of the base part 8, in a locked position when the divider member 11 extends transversely of the base part 8.

In particular, the shaped member 52 has a relatively large longitudinal extent and is adapted for being inserted into the rear channel 12. The formation of the divider member from wire member 50 provides flexibility to permit the divider member to be installed on the base part at any longitudinal location therealong by engaging the shaped member 52 into the rear channel and applying rearward pressure to the front of the divider member to resiliently bend the loop 51 rearwardly until it enters the front channel 12 and the divider member becomes secured in the base part by resilient locking action. In certain circumstances when the book divider may be subjected to larger lateral forces, U-shaped member 52 can also be provided at the front instead of bend 51.

Figure 14:
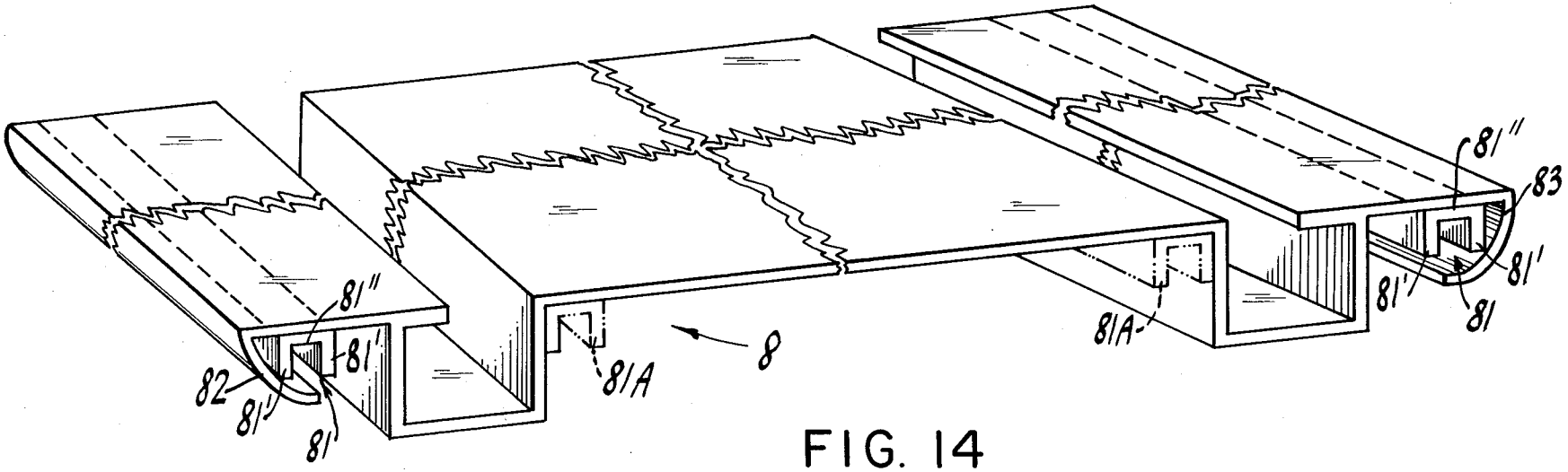
FIG. 14 is a perspective view, broken longitudinally, of a base part adapted for separate utilization as a shelf.
Figure 15:
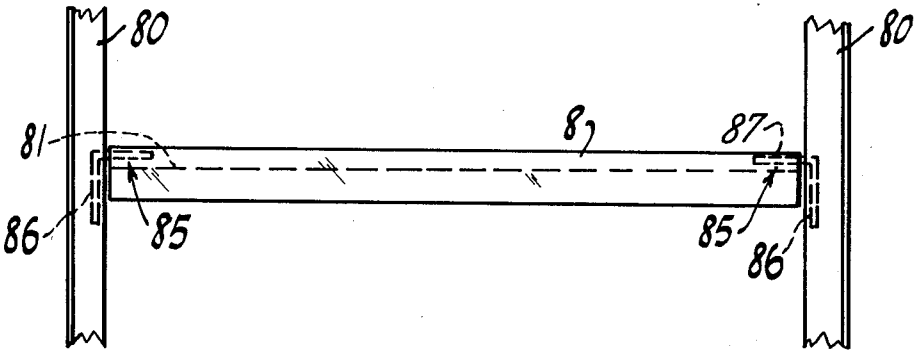
FIG. 15 is a diagrammatic side view showing the base part supported as a shelf.
Figure 16:
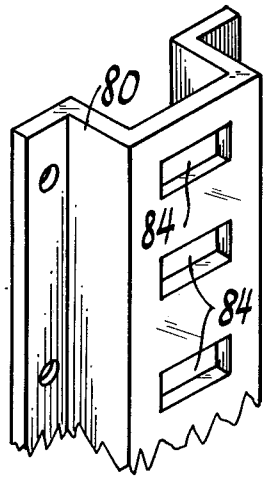
FIG. 16 is a diagrammatic perspective view of a channel for the support of the base part as a shelf.

The configuration of the base part 8 enables this part itself to be used as a shelf in combination with support channels 80 as shown in FIGS. 14–16.

As seen therein the base part 8 of plastic material is provided with rigid support members 81, for example, of metal. The support members 81 are shown to be of inverted U-configuration with opposite flanges 81' and each member 81 is fixedly secured by its base 81" to base part 8 at lateral edge portions 82 and 83. The support members 81 can be alternately positioned laterally inwards of recesses 12 as shown in dotted outline at 81A in FIG. 14. The members 81 extend to the lateral edges of the base part.

The channels 80 can be provided in opposite walls of a cabinet. Each channel 80 is provided with a vertical row of slots 84. The base part 8 can be approximately positioned at a selected vertical level and supported at the slots 84 in the channels by means of L-shaped shelf support members 85. The members 85 each has a depending leg 86 which can be inserted into a slot 84 at a selected level from the shelf and a projecting leg 87 which can be inserted into the associated support member 81.

While the invention has been described in relation to specific embodiments thereof, it will become apparent to those skilled in the art that numerous modifications and variations can be made without departing from the scope and spirit of the invention as defined in the attached claims.

What is claimed is:

1. A modular storage system comprising an elongated base part having two spaced continuous channels extending generally parallel to one another longitudinally of said base part, said base part including a longitudinal rim extending along each channel and projecting over a portion of the width thereof, the rims of the two channels projecting in opposite directions towards one another, an upright member extendable transversely of said base part, said upright member having a lower edge and including a pair of spaced, downwardly projecting lug means at said lower edge respectively engaged in said channels in said base part, said pair of lug means facing in opposite directions away from one another and being spaced apart in relation to the spacing of said channels so as to be fitted with interference in said channels beneath said rims with the upright member extending in a vertical plane disposed transversely of the base part, said lug means being freely insertable into and removable from said channels, without interference from said rims, when the upright member extends in a vertical plane which is angularly offset around a vertical axis from the vertical plane extending transversely of the longitudinal channels, said lug means having engaging surfaces when operatively engaged in said channels with interference fit when the vertical plane containing the upright member extends transversely of the longitudinal channels to elastically and tightly hold said upright member transversely of said longitudinal channels, a back member two side members, said back member having upper and lower edges extending longitudinally of said base part, said side members having front and rear edges, said upright member having front and rear edges, and means extending longitudinally along said upper and lower edges of the back member and the rear edges of said upright and side members for resiliently securing the same together in snap-engagement to lock said side members and said upright member to said back member as a rigid assembly on said base part, said means including respective lips and recesses which cooperate so that the lips on one member can engage in the recesses of another member with snap-fit, the parts with the lips including resilient portions on which said lips are formed to provide snap action for engaging lips in the respective recesses, the snap engagement of said upright member and said back member acting in combination with the interference fit of the lug means in said channels to resiliently secure the upright member on said rigid assembly on said base part at any selected location along the length of said base part.

2. A modular storage system as claimed in claim 1, wherein said means at the upper and lower edges of said back member extends continuously along the entire longitudinal length of said back member.

3. A modular storage system as claimed in claim 2 wherein said means at said upper and lower edges of said back member comprises rounded, elastic portions said with lips at the free ends thereof and said upright member and side members have said recesses for elastically receiving said lips with said snap-engagement.

4. A modular storage system as claimed in claim 3 comprising a top part having front and rear longitudinal edges attachable to said upright member and means extending longitudinally at said front and rear longitudinal edges of said top part and the front and rear edges of said upright member for resiliently securing the same together in snap-engagement.

5. A modular storage system as claimed in claim 4 wherein the means at said front and rear longitudinal edges of said top part comprises elastic portions with lips and said upright member has slots at said front and rear edges for elastically receiving said lips with said snap-engagement, said recess of said rear edge of the upright member extending from said slot therein.

6. A modular storage system as claimed in claim 1 wherein said longitudinal rim engages the respective lug means and prevents separation therefrom when the upright member is transverse to said channels.

7. A modular storage system as claimed in claim 6 wherein each said lug means includes a projection comprising a first part provided with the engaging surface and a second part bracing said first part.

8. A modular storage system as claimed in claim 7 wherein said first and second parts form a T-shape.

9. A modular storage system as claimed in claim 8 wherein said projection includes a third back part from which said T-shape parts project.

10. A modular storage system as claimed in claim 1 comprising a top part attachable to said side member and to said upright member.

11. A modular storage system as claimed in claim 10 wherein said upright member includes support means for supporting a shelf from the upright member.

12. A modular storage system as claimed in claim 10 wherein said base part includes depending feet and said top part includes recesses aligned with the feet so that the feet of the base part of one system can be inserted into the recesses in the top of a second system in order to stack one system on the other.

13. A modular storage system as claimed in claim 10 wherein said base part includes means for supporting said base part as a shelf.

14. A modular storage system as claimed in claim 1 comprising a top part attachable to said upright member with snap engagement and clip means for laterally holding said top part and upright member together.

15. A modular storage system as claimed in claim 14 wherein said clip means includes a first grip part and a second engagement part, one of said parts engaging the upright member the other part engaging the top part.

16. A modular storage system as claimed in claim 15, wherein said grip part includes teeth for biting into the associated part which it engages.

17. A modular storage system as claimed in claim 1 wherein said base part comprises an extruded plastic member and said upright member comprises a molded part of plastic material.

18. A modular storage system as claimed in claim 1 comprising a shelf, and a second upright member supported by said base part in longitudinally spaced relation from said first upright member, said upright members each including projecting ledges on which said shelf rests.

19. A modular storage system as claimed in claim 18 wherein said shelf includes a longitudinal rib, said ledges of the two upright members facing one another and having offset slots with respective edges, the edges of one slot being respectively offset from the edges of the other slot, said rib being centered and received in said slots by bearing against one offset edge of each of the facing slots.

20. A modular storage system as claimed in claim 19 comprising clip means for engaging said shelf and said upright members to restrict lateral movement of said shelf.

21. A modular storage system as claimed in claim 18 wherein said shelf includes a drawer.

22. A modular storage system as claimed in claim 1 further including a book divider comprised of a wire bent to a configuration to provide opposite ends and means at said ends for respectively engaging in said channels of said base part to secure the divider to the base part with said wire of said divider under spring tension.

* * * * *